US005812685A

United States Patent [19]

Fujita et al.

[11] Patent Number: 5,812,685

[45] Date of Patent: Sep. 22, 1998

[54] NON-DIRECTIONAL SPEAKER SYSTEM WITH POINT SOUND SOURCE

[76] Inventors: Takeshi Fujita, 1181-10 Yoshidacho, Totsuka-ku, Yokohama, Kanagawa; Kenji Murata, 13-41, Ichibancho 2-chome, Tachikawa-shi, Tokyo, both of Japan

[21] Appl. No.: 610,999

[22] Filed: Mar. 7, 1996

[51] Int. Cl.[6] ..... H04R 1/02

[52] U.S. Cl. ..... 381/90; 381/107; 381/88; 181/144; 181/153

[58] Field of Search ..... 381/24, 88, 89, 381/90, 153, 155, 159, 188, 205, 103, 107; 181/148, 153, 189, 198, 200, 205, 144

[56] References Cited

U.S. PATENT DOCUMENTS

| | | | |
|---|---|---|---|
| 4,673,057 | 6/1987 | Glassco | 181/144 |
| 4,890,689 | 1/1990 | Smith | 181/144 |
| 5,384,856 | 1/1995 | Kyouno et al. | 381/103 |

FOREIGN PATENT DOCUMENTS 0787585 3/1995 Japan .

*Primary Examiner*—Curtis A. Kuntz
*Assistant Examiner*—Duc Nguyen
*Attorney, Agent, or Firm*—Rogers & Killeen

[57] ABSTRACT

A speaker system is disclosed which is capable of supplying reproduced sounds vibrating in substantially the same manner as in the respiratory sphere to human's sense of hearing by using conventional unidirectional speaker units in combination in a contrived arrangement, and by applying real time digital signal processing by means of a digital signal processor to the speaker units to cancel a peak and a dip in frequency response and in phase response through inverse correction which cannot be canceled only by improving the arrangement of the speaker units, thereby forming a sound emitter capable of providing ideal reproduced sounds. The speaker system comprises an enclosure EC having a basic structure of a hollow 32-hedron composed of 12 pentagonal flat surfaces 1 and 20 hexagonal flat surfaces 2, speaker units 7, 8 or 78 mounted in all or 25–31 of the 32 surfaces, and a real time digital signal processing system inserted in a input line of each of the speaker units 7, 8 or 78. The digital signal processing system inverse-characteristically filtering driving signals of the speaker units to evenly correcting a peak 4 and a dip 5 caused in frequency response and in phase response of each of the speaker units 7, 8 or 78.

10 Claims, 4 Drawing Sheets

NON-DIRECTIONAL SPEAKER SYSTEM WITH POINT SOUND SOURCE

BACKGROUND OF THE INVENTION

1. Field of the Invention

The present invention relates to a non-directional speaker system with a point sound source which is capable of emitting a spherical sound wave whose focal point is clear to the surrounding space all around the speaker system. It relates to a speaker system which is capable of stereophonically reproducing presence of each sound emitter such as a person's voice or a musical instrument which is included in a sound source.

2. Description of the Prior Art

When a tuning fork is struck to vibrate, vibration of air whose sound emission source is the tuning fork spherically propagates over the surrounding space around the tuning fork. In other words, because the sound emitted from the tuning fork is heard at substantially the same sound pressure at any spatial positions equidistant from the tuning fork irrespective of directions, the sound wave emitted from the struck tuning fork is recognized to propagate as a spherical wave. When the sound of the tuning fork is collected and recorded through a microphone and reproduced by a conventional speaker system comprising a hexahedron (rectangular parallelepipedic enclosure) and a speaker unit disposed on one of the surfaces of the hexahedral enclosure, sound pressure level is high only in the front of the speaker unit but low outside the front. Accordingly, the spherical wave from the tuning fork cannot be reproduced.

Heretofore, speaker systems have been used in reproduction of a music, amplification of a speech, reproduction of natural sounds and sound effects in a movie, and the like. However, many of sound emitters included in the sound source reproduced through a speaker unit, for example, percussion instruments and wood winds are non-directional and emit a spherical wave. Further, although stringed instruments have a sound emitting portion on one side thereof, they are roughly regarded as substantially non-directional sound emitters because of sound box-induced resonance acting as an influential tonal quality factor. Therefore, the majority of sound emitters may be considered to emit a non-directional spherical wave.

On the other hand, it is considered that human's sense of hearing detects direction of a sound source through direct sounds coming from a musical instrument in the shortest course, and in parallel, compares information on indirect sounds from surrounding reflective objects such as a floor, a wall and a ceiling with experiential values, thereby realizing distance to the musical instrument, i.e., sound source, reality of the musical instrument, and vividness.

Some of brass instruments such as a trumpet have their tones extremely different between the front and the rear thereof, that is, they are highly directional. In such highly directional instruments, frontal tones correspond generally to the sounds intrinsic to the instruments. This is similar to sound emitting mode of a nomodirectional speaker system. Accordingly, it tends to be considered that a non-directional speaker system with a point sound source is not suitable for reproducing sounds of brass instruments. However, with respect to sounds reproduced by a speaker system, in the absence of appearance of a player, a person who hears the reproduced sounds needs information on the sense of distance through indirect sounds so as to recognize existence of a musical instrument such as a trumpet or presence of sounds emitted therefrom. To reproduce with high fidelity any sounds from the above sound emitters, i.e., sound emitters which emit sounds in various mode, use of a non-directional spherical wave speaker system with a point sound source is preferred which is capable of exhibiting excellent characteristics in reproduction of sounds of unidirectional and highly directional musical instruments. The reasons for this are as follows.

(a) In a unidirectional speaker system of the most ordinary type, which comprises a hexahedral enclosure and a speaker unit mounted to one of the surfaces of the enclosure, right sounds of musical instruments are emitted only in the direction of the front of the speaker system, and other sounds corresponding to indirect sounds of the sound source are emitted in other directions than the front direction. It follows then that two different musical instruments respectively emitting the direct sounds and the indirect sounds are virtually existent at the position of the sound emitter. This causes a delicate gap between acoustic images, and as a result, prevents person's sense of hearing from forming an acoustic image with reality.

(b) In view of this problem, speaker systems have been proposed in, for recent example, Japanese Patent Unexamined Publication No. 205490/1994 which comprise a polyhedral or spherical enclosure and speaker units uniformly mounted on the surface(s) of the enclosure, and some of them have been practically used. Further, a report on "non-directional speaker" has been published in "JAS JOURNAL, September, 1993".

However, with respect to such a conventional spherical wave emitting type speaker system comprising a polyhedron or sphere and speaker units mounted thereon, it has been known that a peak and a dip are observed in frequency response. Such a conventional speaker system has a drawback that it cannot be driven as a high fidelity speaker system unless the peak and the dip are corrected.

(c) On the other hand, it has been known in conventional analog technique that when the defect in frequency response is corrected, phase distortion is concomitanly caused. There have been experimental reports on correction effected by means of an analog equalizer with a view to elucidating relationship between the phase distortion and auditory feeling. As an example of those reports, there may be mentioned "Phase and tonal quality" reported in "pre-lecture publication for AES Tokyo Convention, 1995".

It is, however, difficult to effect correction by analog treatment at strict sound pressure level. Further, phase response is affected by correction of frequency response. Accordingly, it has been said that a clear acoustic image cannot be obtained by a conventional non-directional speaker system using analog technique.

(d) Further, a speaker system which generates a quasi-spherical wave using a round reflector has hereto fore been proposed as one type of non-directional speaker systems.

In the speaker system, however, frequency response and phase response are affected due to the reflector. In spite of the fact that cancel treatment is required to cope with the undesired influence, the speaker system is not constructed taking this point into consideration. Accordingly, reproduction of a point sound emitter, which is a basic performance of a non-directional speaker system, is not realized.

(e) Recently, it has been attempted to evenly correct frequency response and phase response of a speaker system using a hexahedral enclosure by real time digital signal processing by means of a digital signal processor. However, this attempt has been made with a view only to applying digital signal processing to a multiway speaker unit mounted to a conventional hexahedral enclosure. Accordingly, the attempt is not development of a speaker system which, per se, is capable of realizing a non-directional spherical sound wave with a point sound source which is sound emission mechanism of a natural sound.

(f) Such a real time digital signal processing unit using a digital signal processor as mentioned above has been commercially available as a digital equalizer which is unitary. When a speaker system with a digital equalizer is constructed using such a digital equalizer, it is as shown in the block diagram in FIG. 6. When the speaker system in FIG. 6 is used in, for example, a public address system or the like, the following problems are caused.

Generally, in a public address system, an analog attenuator 13 is provided in a monitor output portion of a mixing console which is operated by a mixing engineer, and sound volume is controlled by operating the attenuator 13. When the speaker system in FIG. 6 is used in a high fidelity audio system, the attenuator 13 is provided in a control amplifier which is operated by a listener, and sound volume is controlled by operating the attenuator as described above.

On the other hand, in the speaker system in FIG. 6, an analog attenuator 14 inserted in advance of a power amplifier 17 is usually preset for presetting input gain of the power amplifier 17. Accordingly, if the analog attenuator 14 is set so as not to cause distortion of output sounds of a speaker unit 18 at the maximum power, in usual conditions operated at lower volume levels, sound volume is controlled by the analog attenuator 13 located at the upper stream of the input system. This leads to a low level of signals inputted to an A/D converter 15, thereby preventing the A/D converter 15 from performing highly precise analog-digital conversion. As a result, low levels of input signals are processed by a digital equalizer 16, and computing errors are accumulated in the course of signal processing. Consequently, there is a problem in that disadvantages such as increase of noise and aggravation of distortion ratio are caused.

To solve the above-mentioned problem, a speaker system has been proposed and practically used which comprises a master attenuator 20 placed within reach of a mixing engineer and a special signal line 21 for level controlling signals besides a sound signal line to control the analog attenuator 14. When this system is applied to, for example, a system using a number of speaker units in parallel, such as a public address system, the resulting system has a construction as shown in the block diagram in FIG. 7. However, in such a large-sized speaker system, for example, an incident is likely to be caused that even if reduction of sound volume is required at the end of a tune, sound volume is out of control in only one channel and the sound volume of the speaker unit 18 of the channel cannot be reduced due to a cause such as contact failure of a connector.

As described above, in terms of sound emission mechanism of sound emitters, such as musical instruments and natural sound emitters, whose sounds are to be reproduced by a speaker system, there are many non-directional sound emitters, and listener's sense of hearing recognizes existence of a sound emitter more clearly by indirect sounds. In view of these facts, a non-directional speaker system with a point sound source is considered to be an ideal sound emitter for reproducing sounds emitted by a sound emitter with high fidelity.

Further, conception of "respiratory sphere" has heretofore been known. If sounds can be reproduced by a speaker system in such a manner that entire surface of a sphere is uniformly expanded and contracted to transmit vibrations of sound wave to air, it is possible to listen reproduced sounds in the same mode as sound emission mechanism of musical instruments or natural sound emitter, i.e., in such a mode that sound at the same sound pressure can be heard at positions equidistant from the speaker system. However, a non-directional speaker system with a point sound source has not been provided which is capable of reproducing sounds in a wide range of about 20 Hz to about 20 KHz in the same manner as that of the respiratory sphere.

SUMMARY OF THE INVENTION

It is, therefore, an object of the present invention to provide a speaker system which is capable of supplying reproduced sounds vibrating in substantially the same manner as in the respiratory sphere to human's sense of hearing by using conventional unidirectional speaker units in combination in a contrived arrangement, and by applying real time digital signal processing by means of a digital signal processor to the speaker units to cancel a peak and a dip in frequency response and in phase response through inverse correction which cannot be canceled only by improving the arrangement of the speaker units, thereby forming a sound emitter capable of providing ideal reproduced sounds. It is another object of the present invention to effect real time digital signal processing in optimum conditions without additionally providing a special signal line for controlling signals of the attenuator, by inserting an analog level controller practically required such as an analog attenuator downstream from a D/A converter in an input signal line.

The present invention has been made with a view to solving the above-mentioned problems.

According to the present invention, there is provided a non-directional speaker system with a point sound source comprising:

- an enclosure having a basic structure of a hollow 32-hedron composed of 12 pentagonal flat surfaces and 20 hexagonal flat surfaces,
- speaker units mounted in all or 25–31 of the 32 surfaces, and
- a real time digital signal processing system inserted in a input line of each of the speaker units, the real time digital signal processing system inverse-characteristically filtering driving signals of the speaker units to evenly correcting a peak and a dip caused in frequency response and in phase response of each of the speaker units.

In the above speaker system of the present invention, the enclosure has a basic structure of a hollow 32-hedron composed of 12 pentagonal flat surfaces and 20 hexagonal flat surfaces, and a speaker unit for a low range or low-mid range is mounted in each of 9–12 pentagonal surfaces and a speaker unit for a mid-high range or high range is mounted in each of 15–20 hexagonal surfaces. The speaker units are thereby mounted to the sphere or polyhedron or sphere in such a well-balanced arrangement that a plurality of the speaker units for a mid-high range or high range are disposed around each of the speaker units for a low range or low-mid range. Accordingly, it is to provide a further widened range of reproduced sounds all around the speaker body.

Further, in the above speaker system of the present invention, controlling data for sound volume control are multiplexed into SPDIF or AES/EBU signals which are digital audio interface standard signals and transmitted to a D/A converter block, and level of analog signals resulting from D/A conversion is controlled, thereby always maintaining arithmetic accuracy of the real time digital signal processing system at the best condition. Accordingly, arithmetic accuracy of the real time digital signal processing system can be maintained at the best condition, and sounds are reproduced from the speaker systems without any distortion of information on sound emitters.

DESCRIPTION OF THE PREFERRED EMBODIMENTS

Now, embodiments of the present invention will be described.

As a well-balanced polyhedron preferably used in the speaker system of the present invention, there may be mentioned regular dodecahedron, regular icosahedron, 32-hedron composed of pentagonal surfaces and hexagonal surfaces, 180-hedron and the like. In the present invention, however, the speaker enclosure is preferably a hollow about 32- or more-hedron so as to provide a person with substantially the same auditory feeling as that caused by spherical wave due to a respiratory sphere. In the speaker system of the present invention, positional relationship between a woofer designed to handle a low range and a tweeter designed to handle a mid-high range and optimum location of the arrangement incorporating the positional relationship are experimentally determined using a 32-hedron (which is the polyhedron having minimum surfaces among the above-described preferred polyhedrons) from a practical viewpoint to realize the speaker system of the present invention. In terms of a sound receiving point, in the speaker system of the present invention which uses a hollow 32-hedron as an enclosure, the enclosure is preferably placed in such a manner that the top and bottom surfaces thereof are pentagonal surfaces. The same applies to the case where a sphere whose surface are supposed to be composed of pentagonal surfaces and hexagonal surfaces is used as an enclosure.

Figure 1:
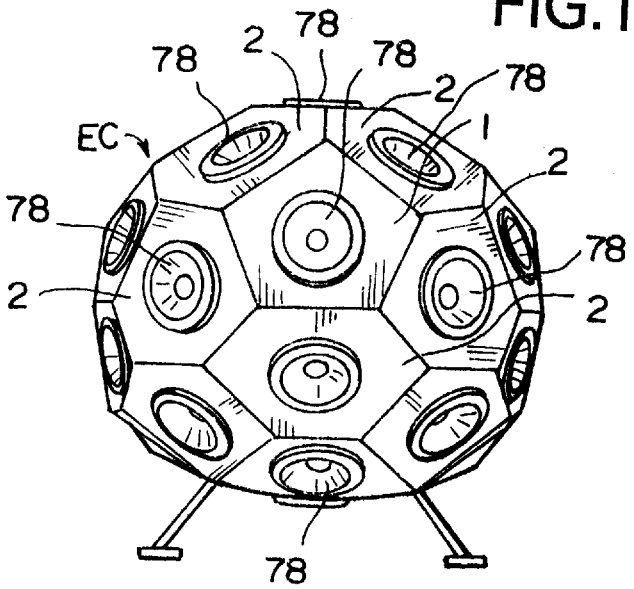
FIG. 1 is a front view of an embodiment of a speaker body in the speaker system of the present invention.
Figure 2:
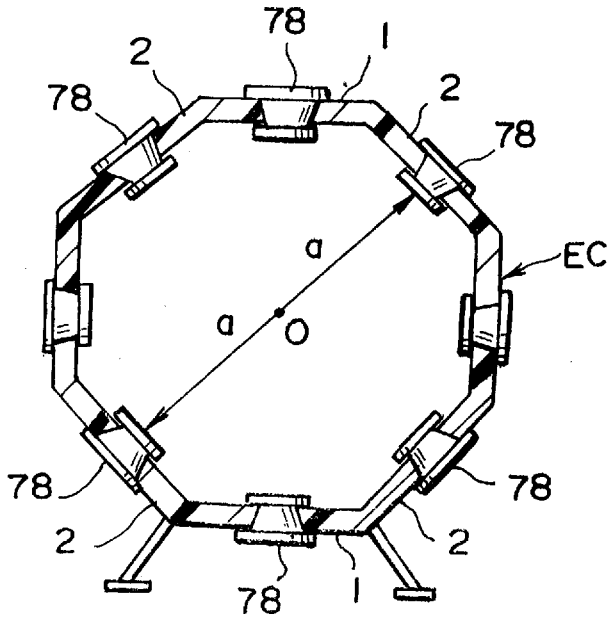
FIG. 2 is a sectional view of another embodiment of the speaker body in the speaker system of the present invention.

In the next place, mode for operation of the speaker system of the present invention will be described with reference to the accompanying drawings. In the speaker system of the present invention, a hollow 32-hedron whose external surface is composed of 12 pentagonal surfaces 1 and 20 hexagonal surfaces 2 is the basic structure of an enclosure EC (which is also referred to as a speaker cabinet or speaker box). All of the 12 pentagonal surfaces 1 or, from practical viewpoint, 9 to 11 of the 12 pentagonal surfaces 1 are each provided with a speaker unit for a low range (woofer) 7, and all of the 20 hexagonal surfaces 2 or, from practical viewpoint, 15 to 19 of the 20 hexagonal surfaces 2 are each provided with a speaker unit for a mid-high range (tweeter) 8 to form a speaker body. Illustrated in FIGS. 1 and 2 are another embodiments of the speaker body, each of which has its pentagonal and hexagonal surfaces 1 and 2 each provided with a full-range type speaker unit 78.

Figure 3:
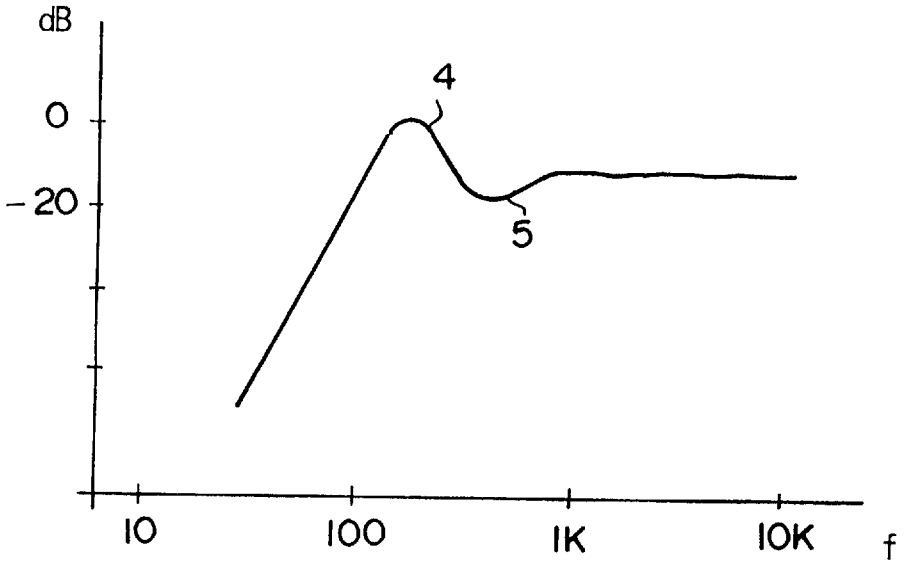
FIG. 3 is a graphical representation showing an example of a peak and a dip in frequency response with respect to a speaker unit used in the speaker system of the present invention.
Figure 4:
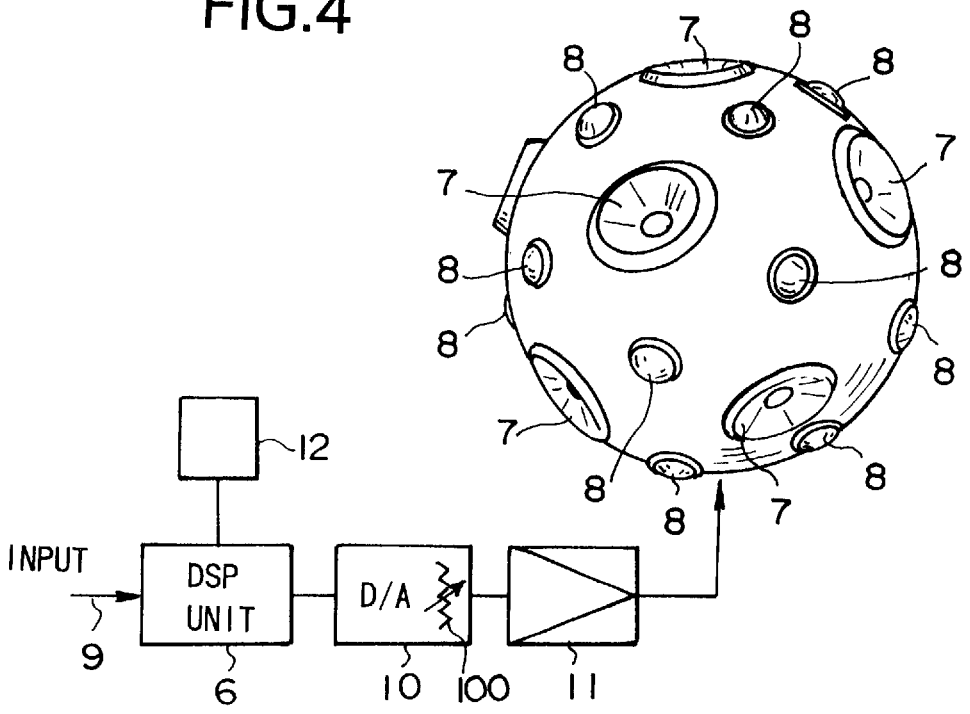
FIG. 4 is a block diagram of an embodiment of the speaker system of the present invention.

If the speaker body, which comprises a 32-hedron provided with speaker units 7 and 8 or speaker units 78 as described above, is actuated without pre-treatment, a peak 4 and a dip 5 are caused in frequency response as diagrammatically shown in FIG. 3. In the present invention, however, to correct the distortion appearing as the peak 4 and dip 5 to substantially even the frequency response, driving signals of the speaker units 78 or speaker units 7 and 8 are subjected to inverse characteristic filtering by means of a digital signal processor 6 (hereinafter referred to as DSP 6) as shown in FIG. 4. In FIG. 4, reference numeral 9 represents a digital input signal inputted to the DSP 6, reference numeral 10 a D/A converter block, reference numeral 11 a power amplifier, reference numeral 12 a controlling panel connected to the DSP 6, and reference numeral 100 an analog attenuator inserted in advance of the power amplifier 11.

In the speaker system of the present invention, when each of the speaker units 7 and 8 or speaker units 78 of the speaker body is driven, a program of a finite impulse response filter (FIR filter) or a program of a combination filter of an FIR filter with an Infinite impulse response filter (IIR filter) is preliminarily loaded into a program memory of the DSP 6 for processing digital input signals which is shown in FIG. 4, and coefficient of inverse correction of speaker responses including distortion of frequency & phase response inherent in each of the speaker units is preliminarily loaded into a coefficient memory.

As shown in the block diagram in FIG. 4, the input signals 9 are subjected to processing for inverse correction of frequency response and phase response by means of the DSP 6 in a real time digital signal processing system, and the digital signals are converted into analog signals by means of the D/A converter 10.

In the present invention, the controlling panel 12 of the DSP 6 forming the real time digital signal processing system is provided with a controlling unit capable of changing output sound volume of each of the speaker units 7 and 8 or speaker units 78. The analog attenuator 100 is controlled by the controlling unit to determine volume of reproduced sound, and a value corresponding to the determined sound volume is allotted to elements of user bit in subcode of AES/EBU, SPDIF or the like which is a serial transmission format for digital audio signals or elements of bit which is not required by the D/A converter in subcode to multiplex control data for controlling sound volume into signals for driving a speaker. The signals for driving a speaker are transferred to the D/A converter block 10.

Figure 7:
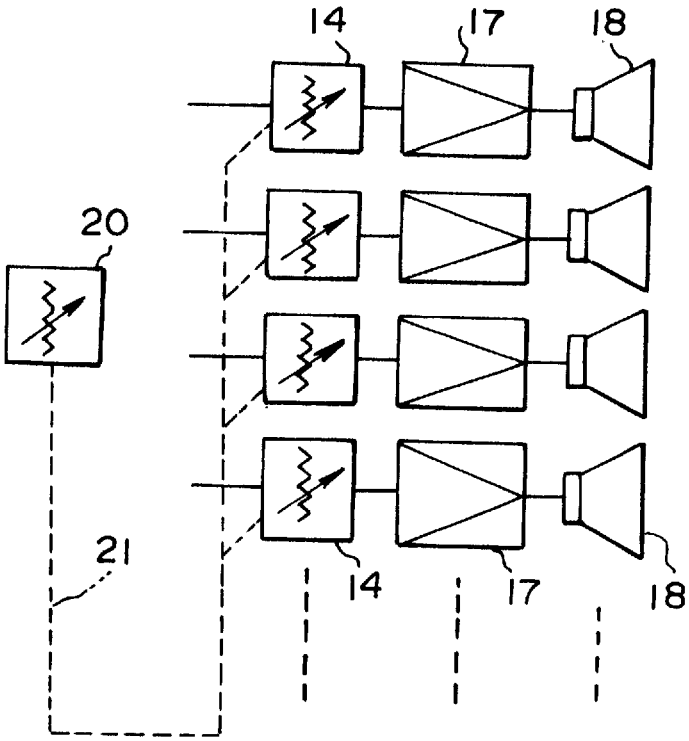
FIG. 7 is a block diagram of one form of a speaker system using the speaker systems in FIG. 6 in parallel.

By virtue of this constitution, a signal line 21 for analog attenuators 14 which is used to control sound volume in the conventional speaker system shown in FIG. 7 can be eliminated. Accordingly, disadvantage is not caused which is due to contact failure of the control line for the attenuators 14 or the like. Further, signal processing by the DSP 6 and sound volume control can be performed using the same controlling panel 12. This enables sound volume to be determined arbitrarily as well as the DSP 6 to be operated at the optimum signal level to constantly maintain arithmetic accuracy at the highest condition. Therefore, no lowering of S/N ratio nor undesirably high distortion degree is caused in reproduced sound. This is because volume information is read out from a subcode in the D/A converter block 10 and converted into an analog audio signal by the D/A converter 10, and level of the audio signal is controlled by the analog attenuator 100.

First Embodiment

FIG. 1 shows an embodiment of a speaker body in the speaker system of the present invention, which comprises an enclosure EC in the form of a hollow 32-hedral frame having stiffness and full-range (gamut) speaker units 78 disposed in the hollow frame equidistantly from the center of the hollow frame. Each of the speaker units 78 of this system is driven by a power amplifier 11.

Analog signals to be inputted to the power amplifier 11 are obtained by filtering input signals in real time by means of digital signal processing in a DSP 6 to correct characteristics of the speakers 78, and converting the resulting digital output signals into analog signals by a D/A converter 10. The analog signals are amplified by the power amplifier 11 to drive speaker units 78.

Second Embodiment

FIG. 2 shows another embodiment of a speaker body in the speaker system of the present invention, which comprises an enclosure EC in the form of a hollow spherical frame having stiffness and full-range speaker units 78 disposed in the frame equidistantly from the center 0 of the sphere forming the enclosure EC. Each of the speaker units 78 in this system is driven also by a power amplifier 11.

Signals to be inputted to the power amplifier 11 are pre-treated in the same manner as in the speaker system shown in FIG. 1. When input signals are digital signals, the digital signals per se are treated by a DSP 6 to correct speaker characteristics. When input signals are analog signals, the analog signals are A/D converted and then subjected to treatment by the DSP 6 to correct speaker characteristics. The resulting digital signals are D/A converted to obtain the signals to be inputted to the power amplifier 11.

Third Embodiment

Figure 5:
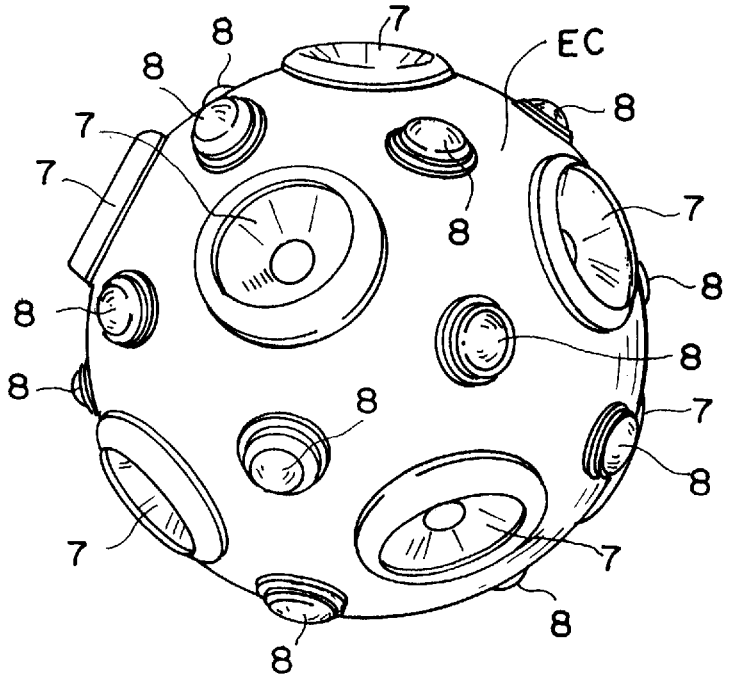
FIG. 5 is a perspective view showing an example of arrangement of speaker units in still another embodiment of the speaker body in the speaker system of the present invention.
Figure 6:
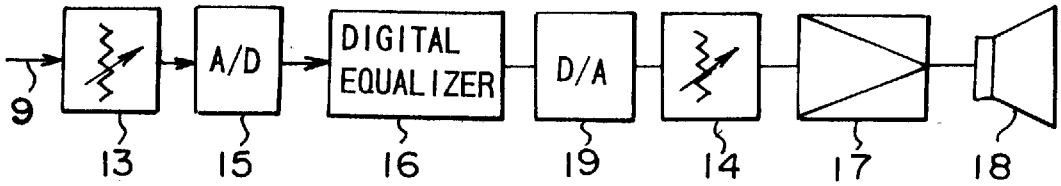
FIG. 6 is a block diagram of one form of a plane baffle type speaker system using a digital equalizer.

FIG. 5 shows a still another embodiment of a speaker body of the speaker system of the present invention, which comprises an enclosure EC in the form of a hollow spherical frame having stiffness and 12 woofers 7 and 20 tweeters 8, and which is constructed by dividing the outer surface of the spherical frame into 12 pentagonal portions 1 and 20 hexagonal, portions 2 and disposing a woofer 7 and a tweeter 8 in each of the pentagonal portions 1 and in each of the hexagonal portions 2, respectively.

Also in the speaker body of the speaker system of the present invention comprising the hollow 32-hedral enclosure and the woofers 7 and tweeters 8 which are disposed on the enclosure in such an arrangement, a peak 4 and a dip 5 are caused in frequency response, as in the two preceding embodiments, when the speaker body as such is driven. To substantially even the peak 4 and dip 5 and poorness in a low frequency range, a real time digital signal processing system which comprises a DSP 6 as main means is inserted in advance of a power amplifier 11.

In the present invention, to subject analog or digital input signals to digital signal processing, a program of an FIR filter or a program of a combination filter of an FIR filter with an IIR filter is preliminarily loaded into a program memory of the DSP 6, and coefficient of inverse correction of speaker responses including distortion of frequency & phase response inherent in each of the speaker units 7 and 8 is preliminarily loaded into a coefficient memory.

By virtue of this, the input signals 9 are subjected to processing for inverse correction of frequency response and phase response by means of the real time digital signal processing system comprising the DSP 6 as main means, and the treated digital signals are converted into analog signals by means of the D/A converter 10. The analog signals are amplified by the power amplifier 11 to drive the speaker system of the present invention.

In the above embodiments, −8 decibel(db) and +10 (dB) are set as correction of the peak 4 and correction of the dip 5 of the frequency response in the DSP 6, respectively. In this connection, the values change depending upon size (volume) of the enclosure EC, types of the speaker units 7, 8 or 78, and other factors. Further, in the third embodiment, the driving signals for the speaker units 8 as tweeters are delayed by about 60 microseconds ($\mu$sec.) as compared with the driving signals for the speaker units 7 as woofers, taking it into consideration that the distance from the center O of the hollow 32-hedron to a diaphragm of each speaker unit 7 as a woofer is different from the distance from the center 0 to a diaphragm of each speaker unit 8 as a tweeter. Analog signals to be inputted to the power amplifier 11 are obtained by filtering input signals in real time by means of digital signal processing in the DSP 6 to correct characteristics of the speakers 7, 8 or 78, and converting the resulting digital output signals into analog signals by the D/A converter 10.

In each of the embodiments of the present invention shown in FIGS. 1, 2 and 5, each of legs for placing the speaker body or a hook (or eye) for suspending the speaker body is located at a vacant portion of the enclosure EC, on which no speaker unit is disposed or a portion on which a speaker unit is not disposed intendedly for this purpose. Further, an input cable for each speaker unit may be introduced in the same manner as above.

Ideally, a high fidelity speaker system for professional consumers, a loud speaker for a public address system or the like, or a speaker system used as a point sound source for measuring acoustic characteristics of a hall, i.e., a converter which converts electric signals into acoustic signals is required to have its sound emitting point at the center of a sphere or sphere-like polyhedron and to be capable of transmitting substantially uniform vibrational energy to the surrounding space all around.

Heretofore, as one capable of exhibiting the above-mentioned performance, a wide-directional speaker system having a 12-hedral enclosure or the like has been provided. However, it has seldom been used in reproducing a music. The reason for this resides in that it is greatly different from the above-mentioned ideal shape because of the small number of its sound emitting surfaces. On the other hand, however, if a hollow sphere or sphere-like hedron is used as a speaker enclosure, correction of so-called "turbulence" of frequency response which is inherent in such an enclosure cannot be effected precisely and appropriately.

As opposed to the above conventional technique, the speaker system of the present invention has such a structure that speaker units are disposed in the surfaces of an enclosure in the form of a hollow sphere or sphere-like polyhedron such as 32-hedron, which surfaces are located equidistantly from the center of the enclosure. By virtue of this, the speaker system of the present invention is capable of emitting substantially uniform vibrational energy and transmitting the vibrational energy to the surrounding space all around. Further, if the speaker system of the present invention is constructed as a multiway loudspeaker system which comprises (a) speaker units allotted to each of more than two specific sound ranges speaker units, input signals for each of the sound ranges are subjected to digital signal processing to correct frequency response. It is thereby possible to attain a wave front generated by sounds emitted from the speaker units, which is uniform and equidistant from the center of a sphere or sphere-like polyhedron such as 32-hedron. Therefore, if constructed as a multiway loudspeaker system, the speaker system of the present invention is capable of emitting substantially uniform vibrational energy to the surrounding space all around.

Moreover, in the speaker system of the present invention, its digital signal processor (DSP) corrects decrease in a low range of frequency response, suppresses increase of frequency response at the frequency point from which the decrease is observed to the lower range, and corrects dip appearing in the higher range. Consequently, it is possible to effectively cancel phase distortion due to differences in distances from the center of the sphere to the speaker units and due to differences in response times of diaphragms of the speaker units.

Furthermore, in the present invention, the enclosure to which the speaker units are mounted has a spherical or sphere-like polygonal structure having a curved surface or polyhedrally continuous surface. It is thereby possible to considerably suppress concomitant sound due to vibration of a hexahedral box (enclosure), which is likely to be caused in a conventional system comprising a hexahedral enclosure composed of flat surfaces to which speaker units are mounted. Further, in the present invention, the speaker units are well-balancedly distributed over the entire outer surface of the sphere or polyhedron in such a manner that a plurality of the speaker units for a high range are arranged around the speaker units for a low to mid-range whose sounds are easily diffused. Consequently, reproduced sounds in the full range are substantially uniformly diffused all around the enclosure, thereby greatly contributing to realization of non-directional reproduced sounds emitted from a point sound source in cooperation with the above-mentioned function.

The present invention is as described above. It is, therefore, possible to provide a non-directional speaker system having a point sound source, which exhibits good localization of acoustic image and excellent reproducibility of propagation of a sound field. Accordingly, the speaker system of the present invention is extremely useful as a so-called high fidelity speaker system for professional or commercial use, a loud speaker for a public address system or the like, or a point sound source for measuring acoustic characteristics of a hall.

What is claimed is:

1. A non-directional speaker system with a point sound source comprising:

an enclosure having a basic structure of a hollow 32-hedron composed of 12 pentagonal flat surfaces and 20 hexagonal flat surfaces, speaker units mounted in all or 25–31 of said enclosure's surfaces, said speaker units comprising:

a woofer mounted in each of 9–12 of said pentagonal surfaces, and a tweeter mounted in each of 15–20 of said hexagonal surfaces, and a real time digital signal processing system inserted in an input line of said speaker units, the real time digital signal processing system inverse-characteristically filtering driving signals of the speaker units to correct a peak and a dip caused in frequency response and in phase response of each of the speaker units.

2. The non-directional speaker system with a point sound source according to claim 1, wherein controlling data for sound volume control are multiplexed into SPDIF or AES/EBU signals which are digital audio interface standard signals and transmitted to a D/A converter block, and level of analog signals resulting from D/A conversion is controlled, thereby always maintaining arithmetic accuracy of the real time digital signal processing system at the best condition.

3. The non-directional speaker system with a point sound source according to claim 1, wherein the enclosure has a basic structure of sphere whose outer surface is suppositionally divided into 32 surfaces.

4. The non-directional speaker system with a point sound source according to claim 3, wherein the speaker units mounted in the outer surface of the sphere-like polyhedron or sphere are such that speaker units for a mid-high range or high range are disposed around each of the speaker units for a low range or low-mid range.

5. The non-directional speaker system with a point sound source according to claim 4, wherein controlling data for sound volume control are multiplexed into SPDIF or AES/EBU signals which are digital audio interface standard signals and transmitted to a D/A converter block, and level of analog signals resulting from D/A conversion is controlled, thereby always maintaining arithmetic accuracy of the real time digital signal processing system at the best condition.

6. The non-directional speaker system with a point sound source according to claim 1, wherein said real time digital signal processing system multiplexes sound volume control data with said driving signals and transmits the resulting signals to a D/A converter block, said sound volume control data controlling the level of analog signals resulting from the D/A conversion, and thereby maintaining optimum arithmetic accuracy of said real time digital signal processing system.

7. An omni-directional speaker system with a point sound source comprising:

a hollow 32-hedron enclosure having 12 pentagonal flat surfaces and 20 hexagonal flat surfaces;

speaker units mounted in at least 25 of said enclosure's surfaces, a low or low-mid range one of said speaker units mounted in each of 9–12 of said pentagonal surfaces, and a mid-high or high range one of said speaker units mounted in each of 15–20 of said hexagonal surfaces, said low or low-mid range ones of said speaker units non-contiguously arranged; and, a real time digital signal processing system inserted in an input line of each of said speaker units, said real time digital signal processing system filtering driving signals of said speaker units to remove distortion, multiplexing sound volume control data with said driving signals, transmitting the resulting signals to a D/A converter block, said sound volume control data controlling the level of analog signals resulting from the D/A conversion, and thereby maintaining optimum arithmetic accuracy of said real time digital signal processing system.

8. The omni-directional speaker system according to claim 7, wherein said filtering involves inverse-characteristically filtering to correct deviations in the frequency response and the phase response of said speaker units.

9. The omni-directional speaker system according to claim 8, wherein said driving signals are SPDIF or AES/EBU signals.

10. The omni-directional speaker system according to claim 7, wherein said driving signals are SPDIF or AES/EBU signals.

* * * * *